United States Patent [19]

Derimiggio

[11] Patent Number: 4,512,649

[45] Date of Patent: Apr. 23, 1985

[54] FUSER APPARATUS

[75] Inventor: John Derimiggio, Rochester, N.Y.

[73] Assignee: Eastman Kodak Company, Rochester, N.Y.

[21] Appl. No.: 540,260

[22] Filed: Oct. 11, 1983

[51] Int. Cl.[3] ..... G03G 15/00

[52] U.S. Cl. ..... 355/3 FU; 355/14 FU; 219/216; 219/471; 323/235; 328/144

[58] Field of Search ..... 355/3 FU, 14 FU; 219/216, 492, 501, 509, 471; 323/235, 236; 328/144

[56] References Cited

U.S. PATENT DOCUMENTS

| | | | |
|---|---|---|---|
| 3,291,466 | 12/1966 | Aser et al. | 263/6 |
| 3,324,791 | 6/1967 | Cassano | 100/172 |
| 3,327,096 | 6/1967 | Bernous | 219/501 |
| 3,369,106 | 2/1968 | Troll | 219/471 |
| 3,742,191 | 6/1973 | Poole et al. | 219/471 |
| 4,046,990 | 10/1977 | White | 219/471 |
| 4,297,562 | 10/1981 | Kamogawa et al. | 219/216 |
| 4,324,486 | 4/1982 | Nishikawa | 355/14 FU |
| 4,391,509 | 7/1983 | Cavagnaro | 355/14 FU |
| 4,402,594 | 9/1983 | Pelda et al. | 219/216 |
| 4,415,800 | 11/1983 | Dodge et al. | 219/216 |
| 4,425,494 | 1/1984 | Enomoto et al. | 219/216 |
| 4,471,210 | 9/1984 | Van Den Eijnden | 219/216 |
| 4,474,456 | 10/1984 | Kobayashi et al. | 355/14 U |

FOREIGN PATENT DOCUMENTS 51-22675 6/1976 Japan .

OTHER PUBLICATIONS

Research Disclosure 19642, Aug. 1980, "Temperature Control of Fuser Roller".

*Primary Examiner*—A. C. Prescott

*Attorney, Agent, or Firm*—William F. Noval

[57] ABSTRACT

Apparatus for fusing a toner image to a support by means of heat and pressure. The fuser apparatus includes a heated fuser member which contacts toner image carrying supports moved along a path. A sensor is spaced from the fuser member for sensing the temperature thereof and for producing a signal representative of the temperature. Logic and control means connected to the sensor maintains the temperature of the fuser member within predetermined limits and interprets a sudden large drop in the temperature sensed as a jam condition caused by a support deviating from its path of movement and interposing between the fuser member and the temperature sensor.

3 Claims, 3 Drawing Figures

FUSER APPARATUS

BACKGROUND OF THE INVENTION

This invention relates in general to apparatus for fusing toner images to toner image carrying supports through the application of heat and pressure. More particularly, this invention relates to fuser apparatus including a sensor for sensing the temperature of a heated fuser member and for producing a signal representative of the temperature of the member which is used to maintain the temperature of the fuser apparatus within predetermined limits and to indicate a jam condition when a sudden large drop in temperature is sensed.

Electrographic copiers produce copies having toner images which are permanently fixed to supports such as copy sheets by well-known fusing techniques. In one such technique, a copy sheet carrying a toner image is contacted by a heated fuser member such as a roller or belt to permanently fuse the toner image to the copy sheet through the application of heat and pressure. The fuser member may be heated by means of an internal or an external heat source. In either case, the temperature of the fuser member is maintained within predetermined limits by sensing the temperature of the heated member and providing a feedback to control the heat source.

Thus, sensors for sensing the temperature of a heated fuser roller may be provided in contact with the fuser roller as disclosed in U.S. Pat. No. 3,291,466 for "Xerographic Fixing Device", issued Dec. 13, 1966, patentees G. A. Aser et al (see, for example FIG. 6, element 825; column 6, lines 56–68); U.S. Pat. No. 3,324,791, for "Xerographic Roller Fuser Drive Apparatus", issued June 13, 1967, patentees J. R. Cassano et al (see, for example, FIG. 2, element THS-2; column 5, lines 66–72); and U.S. Pat. No. 3,327,096 for "Temperature Control Circuit", issued June 20, 1967, patentee T. Bernous. Contact temperature sensors, although useful in controlling the temperature of the fuser roller, may cause damage to the fuser roller surface especially where the surface is of an elastomeric material. Copy sheets which wrap around the fuser roller may engage the sensor resulting in damage to the sensor and jamming of sheets in the fuser.

Temperature sensors for heated fuser rollers may also be spaced a distance from the fusing surface thus obviating the difficulties of sensors which contact the fuser surface. Such sensors are disclosed in U.S. Pat. No. 4,297,562 for "Heat Roller Type Fixing Apparatus", issued Oct. 27, 1981, patentees N. Kamogawa et al (see, for example, FIGS. 1 and 2, column 1, lines 62–66); Research Disclosure No. 1370, entitled "Electrophotographic Fuser Apparatus", dated September 1975 (see, for example, FIG. 3 element 79 and description thereof); U.S. Pat. No. 3,369,106 for "Process Heating Control System", issued Feb. 13, 1968, patentee J. H. Troll (see, for example, FIG. 2, element 6, column 2, line 54 et seq.); U.S. Pat. No. 3,742,191, for "Infrared Temperature Sensor and Control for Use With Heated Moving Bodies", issued June 26, 1973, patentees R. R. Poole et al (see, for example, FIG. 6, element 51, column 4, line 52 et seq.). The latter two patents disclose temperature sensors for measuring infrared radiation from a heated roller. Instead of sensing temperature at the fuser roller surface, the temperature of the fuser core may be sensed to provide temperature control temperature of the fusing roller. Such core sensing controls are disclosed in U.S. Pat. No. 4,046,990 for "Temperature Sensing and Control of a Fusing Roll", issued Sept. 6, 1977, patentee W. E. White (see, for example, FIGS. 1 and 2, element 5, column 4, line 22 et seq.) and Research Disclosure No. 19642 entitled "Temperature Control of Fuser Roller" published August 1980. Where the fuser includes a heater element positioned over a copy sheet path, a sensor may be positioned on the other side of the path to detect temperature variation due to the passage of the copy sheet between the radiation source and the sensor such as disclosed in Japanese Patent Publication No. 76/22675 published June 11, 1976 entitled "Fixing Device for Electronic Copying Machine" (see for example FIG. 1).

During the fusing process there is a tendency for a fused copy sheet to adhere to the fuser roller due to the stickiness of the toner material. Efforts to minimize sticking of copy sheets to fuser rollers include making the surface of the fuser roller of a material which has good release properties, such as silicone elastomer or polytetrafluoroethylene. Silicon release oil may also be applied to the fuser roller surface to enhance the release properties thereof. Since, however, there is still a possibility of a copy sheet adhering to the fuser roller, in commercial copiers a detector is provided in the copy sheet path near the exit nip of the rollers to detect whether or not a copy sheet has advanced past the nip. Such a detector for example is disclosed in U.S. Pat. No. 4,391,509 entitled "Roller Fuser Apparatus In Which Copy Sheet Jams are Minimized," issued July 5, 1983, by W. A. Cavagnaro (see for example FIG. 2 element 70, column 5 lines 47–50 and column 6 line 15 et seq).

Thus, the control of the temperature of a heated fuser member and the detection of paper jams in fuser apparatus are desirable in present day copiers to minimize down time of the equipment due to malfunctions. With higher speed machines, there is also a trend to more complex operational and diagnostic functions. This, it would be desirable to provide copier controls which would simplify the control function while providing efficient and rapid system response to a machine malfunction such as a copy sheet sticking to a fuser roller. It would also be desirable to provide controls for a fuser roller which do not interfere with the fuser components and which do not contribute to fuser roller damage or degradation.

SUMMARY OF THE INVENTION

According to the present invention, there is provided in reproduction apparatus having a path along which toner image carrying supports are moved, fuser apparatus including a heated fuser member which contacts toner image carrying supports moved along said path. There are provided means spaced from said member for sensing the temperature of the fuser member and for producing a signal representative of said temperature. Logic and control means are connected to the sensing means for maintaining the temperature of said fuser member within predetermined limits and for interpreting a sudden large drop in the temperature sensed as a jam condition caused by a support deviating from its normal path and interposing between said fuser member and said means for sensing. Preferably the fuser member comprises an internally heated fuser roller and the means for sensing comprises an infrared detector for detecting infrared radiation from the roller surface.

The invention and its features and advantages will be set forth and become more apparent in the detailed description of the preferred embodiment presented below.

BRIEF DESCRIPTION OF THE DRAWINGS

In the detailed description of the preferred embodiment of the invention presented below, reference is made to the accompanying drawings, like numbers indicating like elements, in which.

DESCRIPTION OF THE PREFERRED EMBODIMENTS

Figure 1:
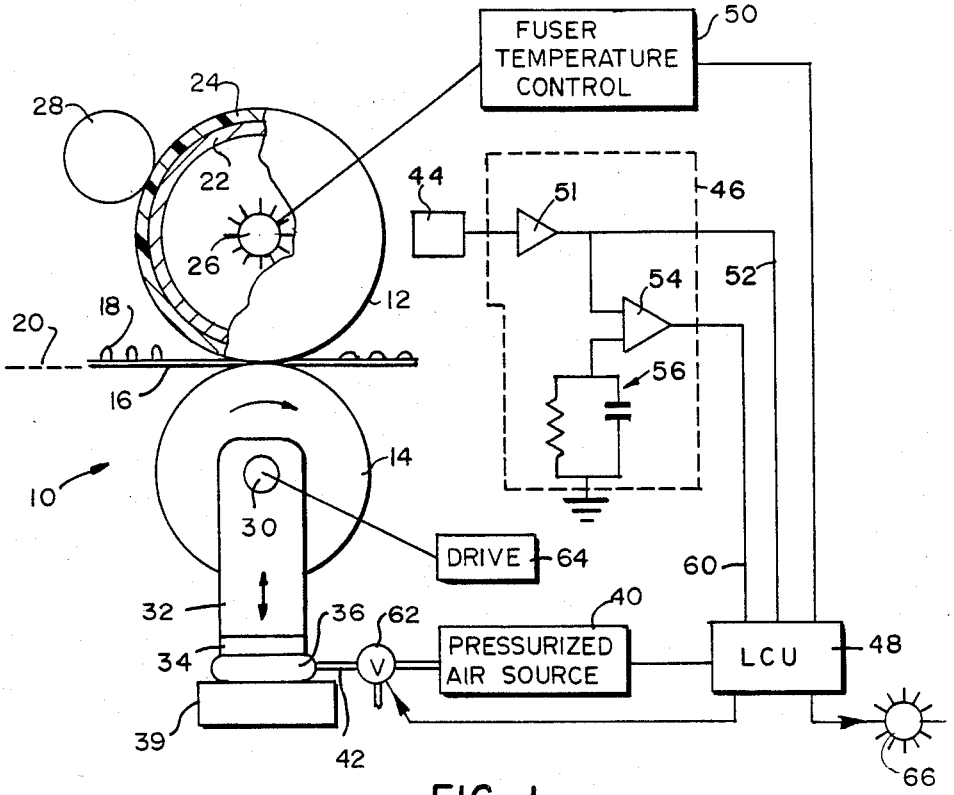
FIG. 1 is a diagrammatic elevational view of a roller fuser incorporating the present invention and including a schematic diagram of suitable logic and control circuitry.

Referring now to FIG. 1, there is shown fuser apparatus according to the present invention. The fuser apparatus may be used in an electrophotographic copier in which a toner image of an original is formed on a reusable photoconductive member and subsequently transferred to a support such as a copy sheet to be fused by the fuser apparatus to produce a permanent copy. An exemplary copier capable of producing simplex copies is disclosed and described in commonly assigned U.S. Pat. No. 3,914,047. An exemplary copier capable of producing simplex or duplex copies is disclosed and described in commonly assigned U.S. Pat. Nos. 4,095,979, 4,174,905, and 4,391,509.

As shown in FIG. 1, fuser apparatus 10 includes an upper roller 12 and a lower roller 14 which form a nip through which a copy sheet 16 carrying a toner image 18 is passed along a copy sheet path 20. Roller 12 includes a cylindrical core 22 of heat conductive material such as aluminum and a fusing layer 24 of high temperature resistant material having good release properties such as silicone elastomer. Mounted internally of roller 12 is a heater element 26 such as a quartz lamp. An applicator roller 28 is provided to apply release material such as silicone oil to the surface of roller 12 to increase its release characteristics.

Roller 14 may be of the same construction as roller 12 if duplex copies are fused or may comprise a pressure roller having a polytetrafluoroethylene coated aluminum core for backing up roller 12. Roller 14 is mounted for rotation by means of gudgeons 30 in upright support members 32 (only one of which is shown). Members 32 are integral with cross member 34. An expandable bladder 36 of resilient material is disposed between member 34 and member 38 mounted to the frame of apparatus 10. Bladder 36 is supplied with pressurized fluid such as air from a source 40 by means of conduit 42.

Spaced from the surface of roller 12 and out of the path 20 of copy sheet 16 is a sensor 44 which detects the temperature of roller 12 and preferably comprises a sensor for detecting infrared radiation. Sensor 44 produces a signal representative of the temperature sensed. A circuit 46 and logic and control unit (LCU) 48 are provided to utilize the temperature signal produced by sensor 44.

A suitable logic and control unit 48 which may be used in the present apparatus is shown and described in the aforementioned commonly assigned U.S. Pat. Nos. 4,095,979 and 4,174,905. Another suitable logic and control unit for use in a simplex copier is shown and described in commonly assigned U.S. Pat. No. 3,914,047.

Circuit 46 includes an operational amplifier 51 which amplifies the signal from sensor 44 and which provides it directly to logic and control unit (LCU) 48 over line 52. The output of amplifier 51 is also fed as one input to operational amplifier 54. A second input is provided by resistor-capacitor circuit 56. When there is a sudden large drop in the temperature sensed by sensor 44, amplifier 54 will provide a signal to LCU 48 over line 60 which is interpreted by LCU 48 as a jam signal.

Logic and control unit 48 controls the amount of energy supplied from fuser temperature control 50 (see, e.g., the controls disclosed in U.S. Pat. 4,046,990 and Research Disclosure No. 19,642, above) to heater element 26 in response to the temperature signal provided from sensor 44 by amplifier 51. LCU 48 also controls the inflation and deflation of bladder 36 by actuating and deactuating pressurized air source 40 in response to copier operation signals and the signal provided by amplifier 54.

Figure 2:
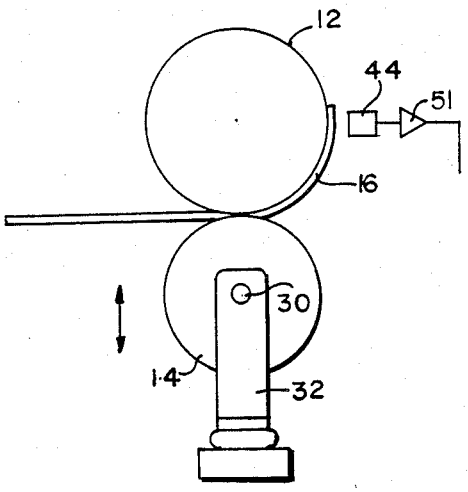
FIG. 2 is a diagrammatic elevational view of the roller fuser of FIG. 1 showing the fuser rollers disengaged.
Figure 3:
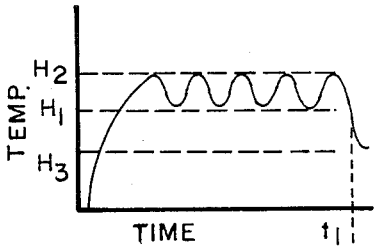
FIG. 3 is a graph of temperature versus time illustrating the operation of the fuser apparatus of the present invention as depicted in FIGS. 1 and 2.

FIG. 3 illustrates the temperature-time relationship of fuser apparatus 10. After the copier is turned on, LCU 48 actuates fuser temperature control 50 to energize heater element 26 to increase the temperature of roller 12 as detected by sensor 44 to fusing temperatures (which may for example be in the range of 150° C. to 200° C.). LCU 48 is programmed to maintain the temperature of roller 12 during fusing within a predetermined range as long as a copy sheet is moved normally through the nip formed by rollers 12 and 14 along path 20. Such a range is illustrated in FIG. 3 by the wavy line oscillating between temperature H1 and temperature H2. However, if copy sheet 16 sticks to roller 12 (see FIG. 2) and interposes between roller 12 and sensor 44, sensor 44 will sense a sudden large drop in temperature (e.g., $h_3$ at t) and amplifier 54 will produce a signal fed along line 60 to LCU 48 which interprets this drop as a sheet jam in the fuser apparatus. In response to this signal LCU 48 actuates valve 62 to deflate bladder 36 thus causing rollers 12 and 14 to separate (FIG. 2). Roller 12 will stop rotating since it is out of driving engagement with roller 14 which is rotated by drive 64. Copy sheet 16 will no longer be driven by roller 12 thus minimizing possible damage to fuser apparatus components. Logic and control unit 48 may also send a signal to a lamp 66 on the copier control panel to indicate to the copier operator a fuser apparatus malfunction.

The invention has been described in detail with particular reference to preferred embodiments thereof. However, it will be understood that variations and modifications can be effected within the spirit and scope of the invention.

What is claimed is:

1. In reproduction apparatus having a path along which toner image carrying supports are moved, fuser apparatus comprising:

a heated fuser member which contacts toner image carrying supports moved along said path;

means, spaced from said fuser member, for sensing the temperature of said fuser member and for producing a signal representative of said temperature; and logic and control means connected to said sensing means for maintaining the temperature of said fuser member within predetermined limits and for interpreting a sudden large drop in the temperature sensed as a jam condition caused by a support deviating from said path and interposing between said fuser member and said means for sensing.

2. The fuser apparatus of claim 1 wherein said means for sensing includes means for sensing infrared radiation from said fuser member.

3. The fuser apparatus of claim 1 wherein said fuser member includes a cylindrical fuser roller and a heater element disposed within said roller and wherein said logic and control means controls the amount of energy supplied to said heater element to maintain the temperature of said fuser roller within said predetermined temperature range.

* * * * *